US006390015B1

(12) United States Patent
Germano

(10) Patent No.: US 6,390,015 B1
(45) Date of Patent: May 21, 2002

(54) BIBLE BOOKMARK AND TRIVIA GAME

(76) Inventor: Matthew Germano, 1514 Moores Ct., Brentwood, TN (US) 37027

( * ) Notice: Subject to any disclaimer, the term of this patent is extended or adjusted under 35 U.S.C. 154(b) by 0 days.

(21) Appl. No.: 09/576,551

(22) Filed: May 24, 2000

Related U.S. Application Data

(60) Provisional application No. 60/136,140, filed on May 25, 1999.

(51) Int. Cl.[7] ..... B42D 9/00

(52) U.S. Cl. ..... 116/235; 116/321; 281/42

(58) Field of Search ..... 116/234–240, 321–324; 281/42; 19/34

(56) References Cited

U.S. PATENT DOCUMENTS

| | | | | |
|---|---|---|---|---|
| 139,936 A | | 6/1873 | Ward et al. | |
| 168,395 A | * | 10/1875 | Harris | 116/234 |
| 399,768 A | | 3/1889 | Mehrer | |
| 1,272,553 A | | 7/1918 | Spotswood | |
| 1,327,019 A | | 1/1920 | Britton | |
| 1,600,108 A | | 9/1926 | Gell | |
| 1,619,756 A | * | 3/1927 | Pearson et al. | 116/323 |
| 1,778,737 A | * | 10/1930 | Szepesi | 116/323 |
| 2,664,847 A | * | 1/1954 | Orman | 116/239 |
| 2,669,964 A | * | 2/1954 | Wexler | 116/324 |
| 4,569,538 A | | 2/1986 | Kurschner | |
| 4,607,848 A | | 8/1986 | Maguire et al. | |
| 4,608,772 A | | 9/1986 | Gill | |
| 4,635,939 A | | 1/1987 | Makow | |
| 4,901,665 A | | 2/1990 | Carlin | |
| 4,934,709 A | | 6/1990 | Peterson | |
| 5,081,948 A | | 1/1992 | Walsh | |
| 5,101,756 A | * | 4/1992 | Strumbos | 116/234 |
| 5,152,535 A | | 10/1992 | Roberts | |
| 5,235,811 A | | 7/1994 | Miroyan | |
| 5,437,240 A | | 8/1995 | Miroyan | |
| 5,443,029 A | | 8/1995 | Garnet | |
| 5,518,409 A | | 5/1996 | White | |
| 5,564,361 A | * | 10/1996 | Satterwhite | 116/323 |
| 5,577,459 A | | 11/1996 | Alden | |
| 5,607,160 A | | 3/1997 | Stevens et al. | |
| 6,050,214 A | * | 4/2000 | Okeefe | 116/323 |

FOREIGN PATENT DOCUMENTS

| | | |
|---|---|---|
| CH | 667623 A5 | 10/1988 |
| GB | 446849 | 5/1936 |
| GB | 612875 | 11/1948 |
| GB | 2222387 A | 3/1990 |
| GB | 2274597 A | 8/1994 |

OTHER PUBLICATIONS

*Playthings*, "Spotlight Trivia Games Spawn Second Generation", May 5, 1985, pp. 76–79.

* cited by examiner

*Primary Examiner*—Diego Gutierrez
*Assistant Examiner*—R. Alexander Smith
(74) *Attorney, Agent, or Firm*—Richard C. Litman

(57) ABSTRACT

A combination bookmark and trivia game having sliding arrow indicators which point to numerical indicia on the front panel of the bookmark, which can indicate the appropriate chapter and verse for a book of the Bible to show the location on the page where the reader stopped reading. Additionally, the bookmark includes a transparent pocket for receiving a trivia game card having a visible printed Bible verse, and a concealed book, chapter, and verse. Players use the sliding arrow indicators to show their choice as to the correct location of the printed verse in the Bible. The transparent pocket can alternatively be used for a prayer list or a prayer pal photo.

6 Claims, 12 Drawing Sheets

BIBLE BOOKMARK AND TRIVIA GAME

CROSS-REFERENCE TO RELATED APPLICATION

This application claims the benefit of U.S. Provisional Patent Application Ser. No. 60/136,140, filed May 25, 1999.

BACKGROUND OF THE INVENTION

1. Field of the Invention

The present invention relates generally to a Bible bookmark and trivia game. More specifically, the present invention is a bookmark which includes sliding indicators showing a specific chapter and verse of a book within the Bible, and a pocket at the rear of the bookmark for displaying a Bible trivia question/answer card.

2. Description of Related Art

The related art of interest describes various bookmarks, but none discloses the present invention. There is a need for a Bible bookmark which reinforces the biblical passages in the form of a game. The relevant art will be discussed in the order of perceived relevance to the present invention.

U.S. Pat. No. 4,608,772, issued to Carlton Gill on Sep. 2, 1986, describes a religious marker for recording verses, chapters and names of the books in the Old and New Testament. The marker device has a plate with two sections. One section has a plurality of rotatably mounted pointers and a circularly arranged numeral row. The other section uses pins slidably mounted within a pair of grooves having printed items.

U.S. Pat. No. 4,569,538, issued to Lloyd F. Kurschner on Feb. 11, 1986, describes a bookmark which includes a hook passing over the binding and preventing the bookmark from sliding completely between the pages. The bookmark has a plurality of referencing slits down its length and a plurality of cords for insertion into the referencing slits.

U.S. Pat. No. 5,081,948, issued to James B. Walsh on Jan. 21, 1992, describes a bookmark having an elongated slot with a slidably and rotatably mounted indicator moving within the slot. The indicator with an arrow points one direction on one side of the bookmark, and the other direction on the opposite side of the bookmark.

U.S. Pat. No. 139,936, issued to Henry M. Ward and George E. Dolton on Jun. 17, 1873, describes a book mark. The book mark has an elastic strap with a hook on either end, and at least one pointer slidably mounted on the elastic strap. U.S. Pat. No. 399,768, issued to Henrietta L. Mehrer on Mar. 19, 1889, describes a book mark as a plate having a pair of arms, with one arm fitting over a page, and the other arm fitting under it. A pointer is slidably and pivotally mounted to the arm fitting over the page.

U.S. Pat. No. 4,901,665, issued to Paul J. Carlin on Feb. 20, 1990, describes a bookmark having a slidable encircling member serving as a line marker.

U.S. Pat. No. 5,325,811, issued to Michael Miroyan on Jul. 5, 1994, describes a bookmark having a planar body and a slidably mounted indicator. The design of the indicator corresponds to whimsical design elements at the top and bottom of the indicator's range of motion. A similar bookmark is described in U.S. Pat. No. 5,437,240, issued to Mike Miroyan on Aug. 1, 1995.

U.S. Pat. No. 5,443,029, issued to Arrow Garnet on Aug. 22, 1995, describes a bookmark having a plate with an adhesive surface for attaching to the book's binding. A plurality of marking straps extend from the plate with each marking strap having a slidable tab for marking a specific location on the page.

U.S. Pat. No. 5,518,409, issued to Willard H. White on May 21, 1996, describes a sliding digital bookmarker. The bookmarker has a base plate and an upper plate having at least 2 slots with a hole adjacent to each slot. A sliding member moves within each slot, having a raised rib protruding from the slot for grasping, and a sequence of numbers which are displayed through the holes.

U.S. Pat. No. 5,577,459, issued to William Alden on Nov. 26, 1996, describes a bookmark having an encircling member slidably mounted to the body of the bookmark. The body of the bookmark specifies the odd or even numbered page, and the last paragraph read. The encircling member is positioned so that its circular front opening shows the last paragraph read.

U.K. Patent Application No. 446,849, published on May 7, 1936, for Alice Winnard describes a marker for an instruction sheet. The marker is a plate having a central tongue detached along three sides and attached along the fourth side, for gripping the sheet between the central tongue and the rest of the plate. A disk is rotatably attached to the marker, and includes numbers for indicating the number of times a given step has been repeated.

U.K. Patent Application No. 612,875, published on Nov. 18, 1948, for Fanny Marx describes a bookmark. The bookmark is a strip of metal having a pair of slots, and at least one sliding member encircling the strip of metal. The slots divide the bookmark into thinner strips, fitting on either side of the page, and the encircling member slides towards the paper to secure the bookmark in place.

Swiss Patent Application No. 667,623 A5, published on Oct. 31, 1988, Susan Bubenik describes a bookmark having slots on each side for retaining sliding members indicating the desired location on the page, and a slot on the bottom for retaining another sliding member indicating either the left or right side page.

U.K. Patent Application No. 2,222,387 A, published on Mar. 7, 1990, for Leslie J. Redelinghuys describes a combination bookmark/business card. The bookmark has a sliding indicator along a short side indicating either the left or right side page, and a sliding indicator along a long side indicating the paragraph number.

Several other trivia games have been proposed by other inventors. However, no other inventor within the knowledge of the present inventor has proposed a trivia game apparatus which also serves as a bookmark.

One example of a game is U.S. Pat. No. 1,272,553, issued to Frank D. Spotswood on Jul. 16, 1918, describes a game device. The game device includes a question card, and an answer disk rotatably mounted to the question card.

U.S. Pat. No. 1,327,019, issued to Coozie Britton on Jan. 6, 1920, describes educational playing cards. Each playing card is divided into three sections on one face, and four sections on the other face, and contains indicia for playing several different games.

U.S. Pat. No. 1,600,108, issued to Alfred Gell on Sep. 14, 1926, describes a card game. The game is intended to teach spelling as well as the names of various animals.

U.S. Pat. No. 4,607,848, issued to Hugh P. Maguire and Helen A. Maguire on Aug. 26, 1986, describes a word game. Players attempt to guess a concealed word based on randomly selected definitional and phonetic clues.

U.S. Pat. No. 4,625,939, issued to Henry Makow on Jun. 13, 1987, describes a question and answer card game. Each player has several question cards and one answer card. The goal is to ask a question to another player whose answer will match the answer on the questioner's answer card.

U.S. Pat. No. 4,934,709, issued to Kevin P. Peterson on Jun. 19, 1990, describes a memory game apparatus. The game apparatus includes a game board having paths in the form of concentric rings, and cards with pictorial memorization aides. Correctly identifying the information conveyed by the pictures on the cards allows a player to move forward on the board.

U.S. Pat. No. 5,152,535, issued to Adolph Roberts on Oct. 6, 1992, describes a bible quiz game. The game includes a board having four easy paths and four difficult paths. Correctly answering questions allows a player to move forward along the paths.

U.S. Pat. No. 5,607,160, issued to Arthur J. Stevens and Linda T. Stevens on Mar. 4, 1997, describes a religious three talent boardgame wherein players move around a triangular board based on the Trinity and answer questions, draw a picture, or act out a word.

U.K. Patent Application No. 2,274,597 A, published on Aug. 3, 1994, for Alan Maxwell describes a game apparatus. The game apparatus includes a game board having a playing track, player representation markers, question cards, dice, and scoring tokens. "Spotlight TRIVIA GAMES SPAWN SECOND GENERATION", Playthings, May 5, 1985, pp. 76–79, gives brief descriptions of numerous trivia board games.

None of the above patents and publication describes a combination of a bookmark with a trivia game. None of the above inventions and patents, taken either singly or in combination, is seen to describe the instant invention as claimed.

SUMMARY OF THE INVENTION

The present invention is a combination bookmark and trivia game. The bookmark includes sliding arrows for indicating the exact location on the page where the reader stopped reading, for example, the last chapter and verse read in the Bible. The rear of the bookmark includes a transparent pocket having several possible uses. Preferred contents of the transparent pocket include a trivia question card, a prayer list, and/or a photograph of a prayer partner.

The front of the bookmark has at least one, and preferably two, arrow-shaped indicators. The arrow-shaped indicators are slidably mounted on the bookmark, secured between the bookmark's rear panel and a pair of front panels. The arrow points towards the first front panel, which includes a series of printed numeral indicia corresponding to each arrow-shaped indicator. The second front panel may contain a description of the corresponding numerical indicia. For example, if two arrow indicators and two sets of numerical indicia are used, the top set of numerical indicia may be designated for use as a Bible chapter indicator, and the bottom set may be designated as a Bible verse indicator. By sliding the top arrow to point towards the chapter currently being read, sliding the bottom arrow to point towards the last verse read, and inserting the bookmark into the correct page in the bible, the reader can mark the exact location where reading was stopped. When the reader begins reading in the future, no time will be wasted reading previously read material.

In one preferred embodiment, the arrow indicators are mounted on bases, with the bases between the front and rear panels, and the arrow indicators outside the front panel. In a further refinement of this embodiment, the tips of the arrow indicators are transparent. The transparent tips may be configured to magnify the numerical indicia, facilitating reading the selected numbers.

The back of the bookmark may include any of several different features. For example, it may contain an advertisement for the organization distributing the bookmark. Alternatively, it may also be used as a trivia game. The back of a bookmark used as a trivia game includes a transparent pocket for containing a trivia question card. The card includes a printed Bible verse on its front side, and its location in the Bible, by book, chapter, and verse, on the back side. When the card is inserted into the pocket, the text of the verse is visible through the transparent cover, but the location is concealed. The players guess the location of the verse by sliding the arrow indicators to the chapter and verse they believe to be correct. They take turns guessing until the correct location is guessed. The players then insert a new trivia question card and repeat the process. The players learn the Bible's teachings, and their location in the bible, by playing the game.

An alternative trivia card includes both the Bible verse and its location on the front of the card. When the card is inserted in the transparent pocket, artwork on the pocket hides the location of the verse, revealing only the verse itself. The back of such a trivia card may contain a list of people to pray for and corresponding prayer requests, as a reminder for use during prayer.

An additional alternative back panel includes a smaller transparent pocket, dimensioned and configured to receive a photograph of a prayer partner. A common Christian practice is the formation of small prayer groups which pray together and for each other when the members are apart.

The bookmark's front and back panels may include several different decorative features, including gem stones, gold chains around the edges, biblical motifs such as angels or crosses, Victorian motifs, and encouraging text.

Accordingly, it is a principal object of the invention to provide a bookmark showing the exact location on a page where the reader stopped reading, thereby avoiding the necessity to search for this location when reading is resumed.

It is another object of the invention to provide a bookmark showing the exact chapter and verse where the reader stopped reading the Bible.

It is a further object of the invention to provide a trivia game.

Still another object of the invention is to provide a Bible study tool.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a combination bookmark and trivia game device. The bookmark can also include prayer reminders, such as prayer request lists and prayer partner/prayer pal photographs.

Figure 1:
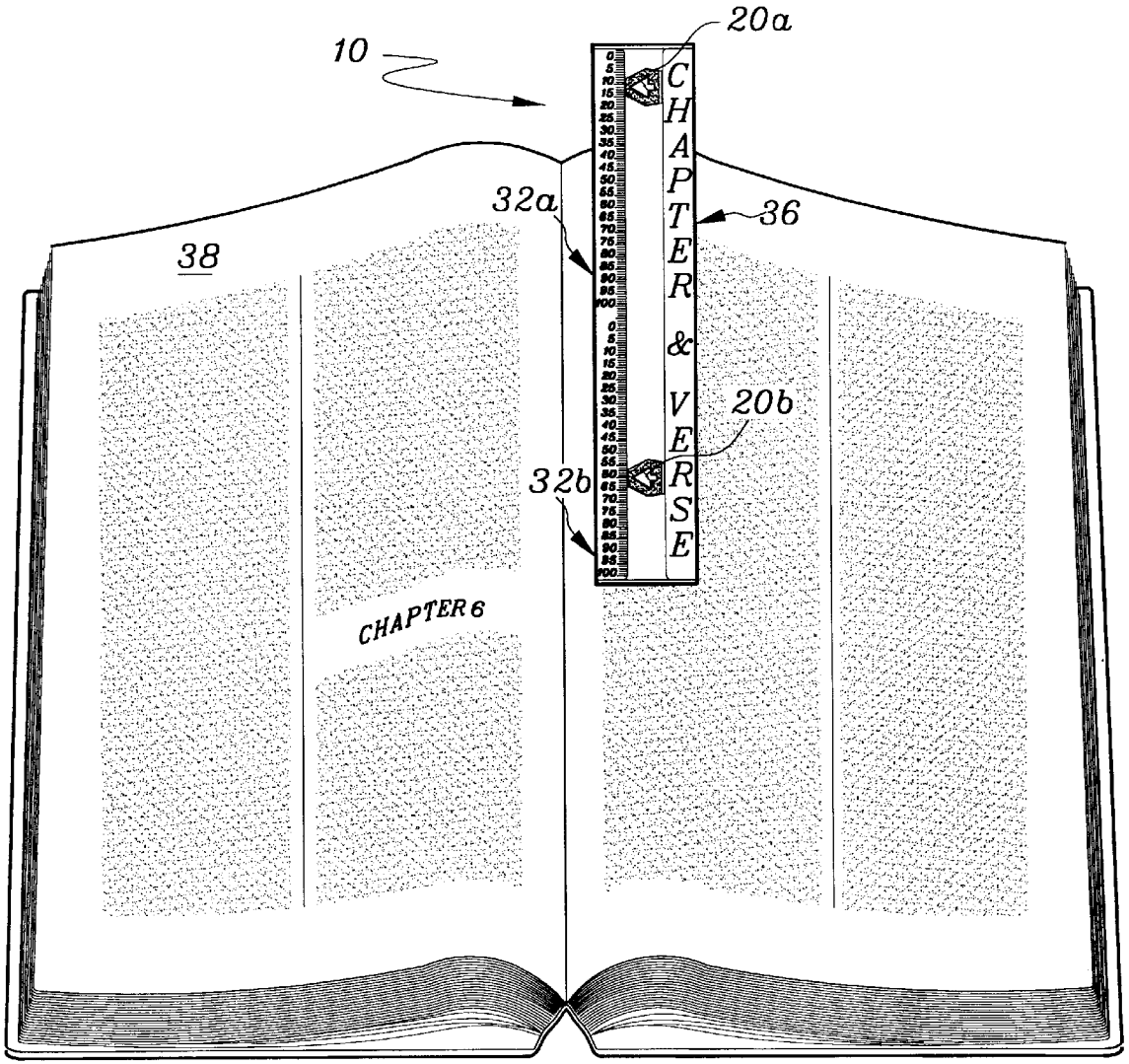
FIG. 1 is an environmental, perspective front view of a Bible bookmark and trivia game device positioned on an opened Bible according to the present invention.

In FIG. 1, the bookmark 10 is intended for use with a Bible 38. Therefore, upper arrow 20*a* and upper numerical indicia 32*a* is designated as an alphanumeric naming indicia 36 as "Chapter," for indicating the chapter wherein reading was stopped. The lower arrow 20*b* and lower numerical indicia 32*b* is designated "Verse," for indicating the last verse read. By sliding upper arrow 20*a* to the number corresponding to the appropriate chapter, sliding lower arrow 20*b* to the number corresponding to the appropriate verse, and placing bookmark 10 between the pages of book 38, the reader can mark the exact location where reading was stopped.

Figure 2:
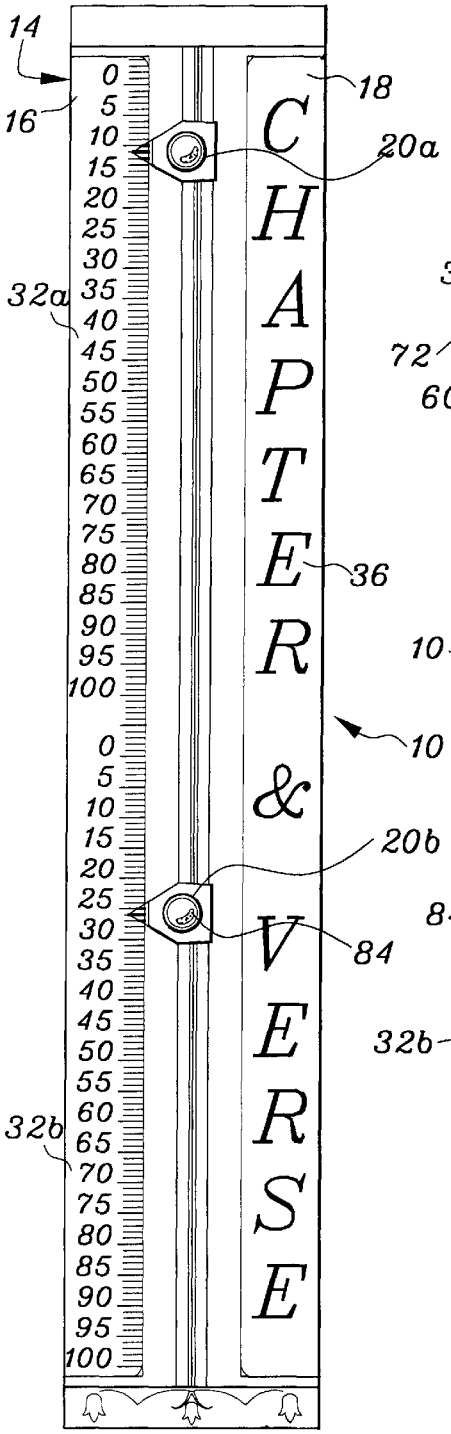
FIG. 2 is a front elevational view of a Bible bookmark and trivia game device according to a first design of the present invention.
Figure 3:
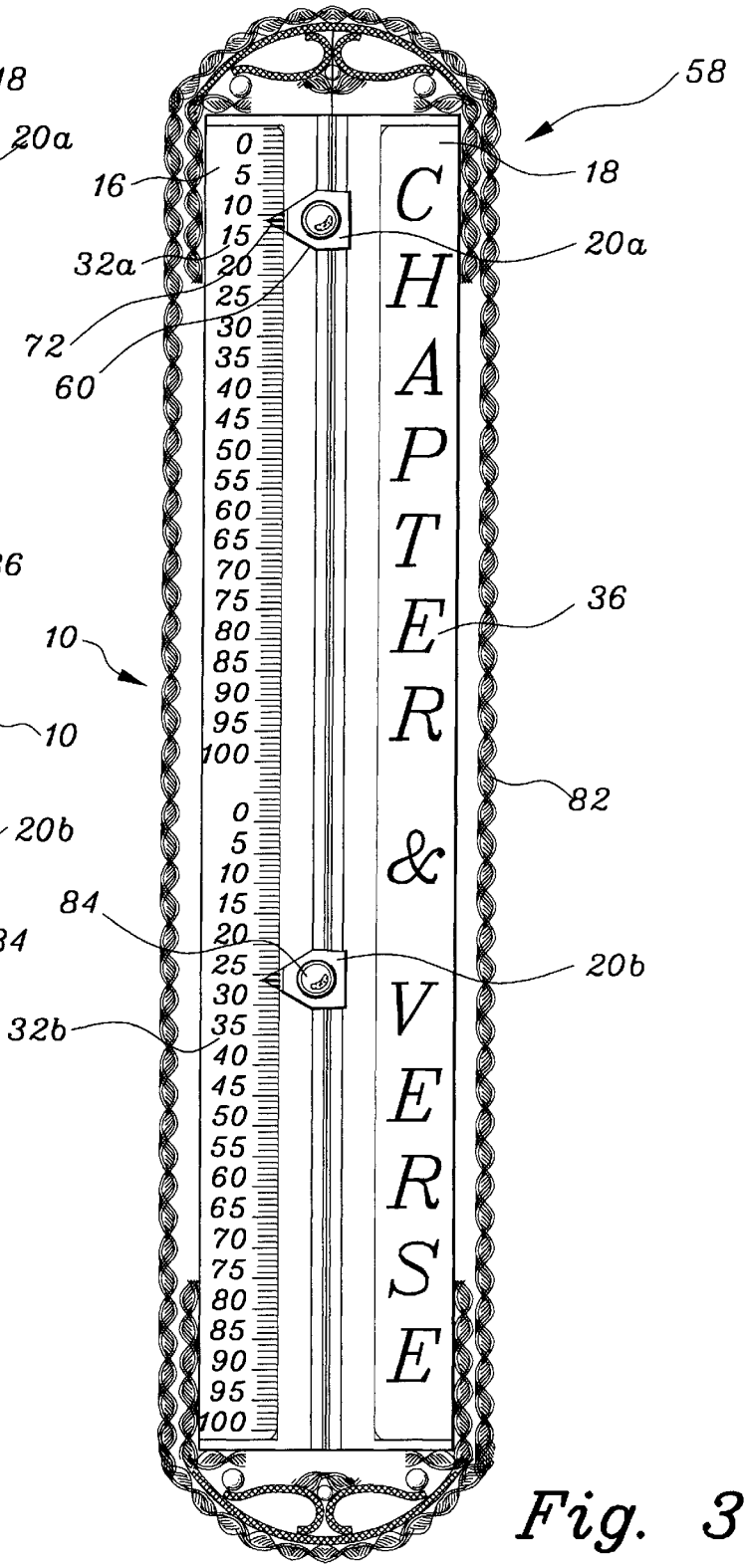
FIG. 3 is a front elevational view of a Bible bookmark and trivia game device according to a second design of the present invention.
Figure 4:
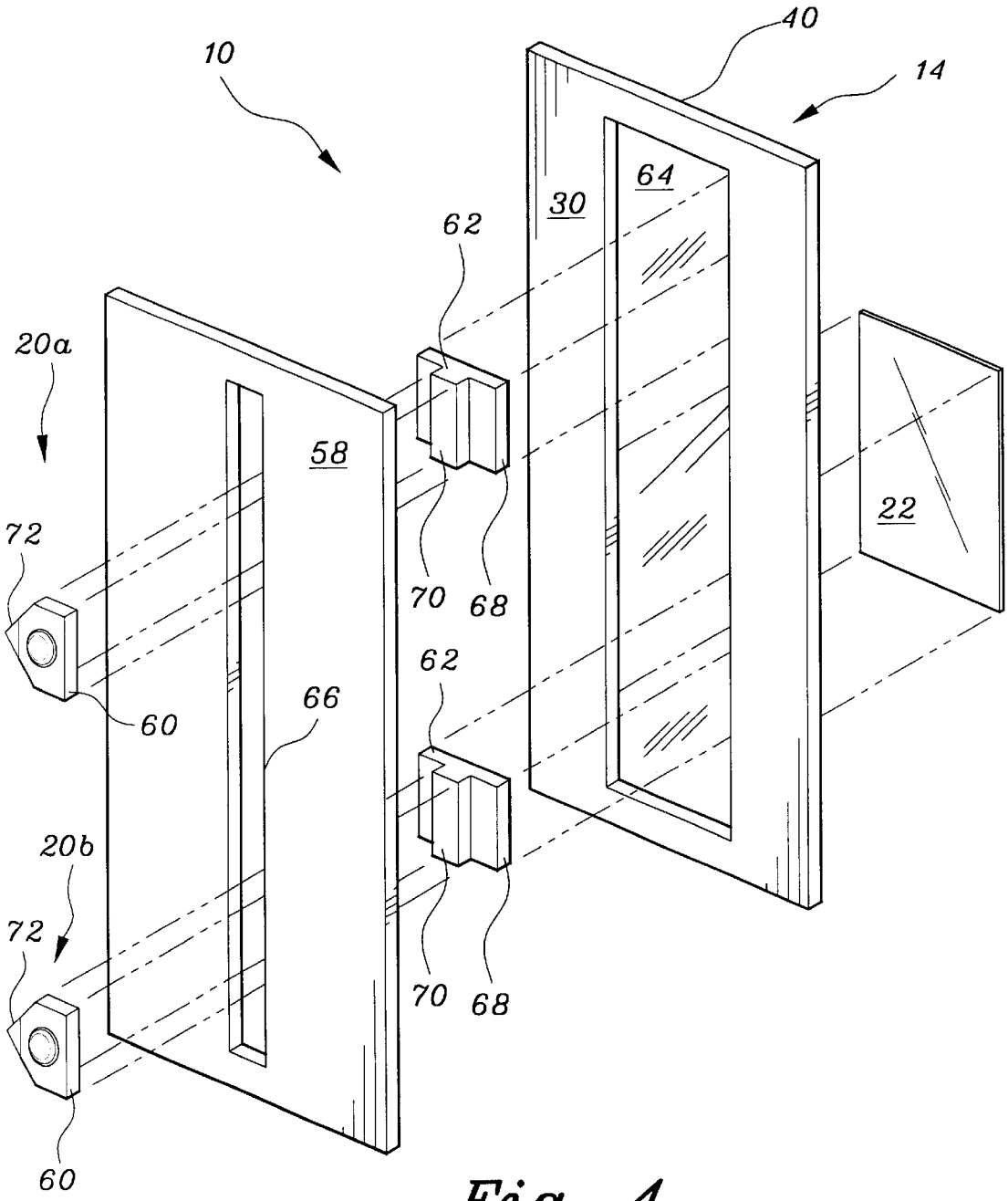
FIG. 4 is an exploded front perspective view of a first embodiment of a Bible bookmark and trivia game device according to the present invention.

Referring to FIGS. 2–5, a preferred first embodiment of the bookmark is illustrated. The invention 10 includes a rear panel 14, front panel 58, sliding arrow indicators 20*a*, 20*b*, and a transparent panel 22 (FIG. 4).

FIG. 4 illustrates a preferred exploded construction of the bookmark 10. Rear panel 14 defines a channel 64 extending vertically from the top to the bottom of its front surface 30. Channel 64 is enclosed at each end, and does not penetrate the back surface 40 of rear panel 14. Front panel 58 defines a corresponding, narrower vertical channel 66, equal in length to channel 64. Each sliding arrow indicator 20*a*, 20*b* includes a pointer 60, and means for slidably securing the arrow within channel 64, which in this embodiment is a base 62. Pointer 60 may include tip 72, which is preferably transparent and configured to provide magnification of visual indicia. Each base 62 includes a rectangular plate 68 and a narrow frontal protrusion 70, with plate 68 being dimensioned and configured to fit within channel 64, and protrusion 70 being dimensioned and configured to fit within the channel 66. Pointer 60 attaches to protrusion 70 so that pointer 60 lies adjacent to front panel 58 opposite base 62. The sliding arrow indicators 20*a*, 20*b* frictionally engage the front panel 58 and rear panel 14 so that they remain in any desired position.

In FIGS. 2 and 3, front panel 58 includes a first side 16 (illustrated as the left side) and a second side 18 (illustrated as the right side). A series of numerical indicia 32*a* corresponds to arrow 20*a*, and numerical indicia series 32*b* corresponds to arrow 20*b*. Each arrow has a pointer 60 with a tip 72. The right side 18 includes alphanumeric naming indicia 36, designating the purpose of each numerical indicia series 32*a*, 32*b*. Other decorative features will be discussed below.

Figure 10:
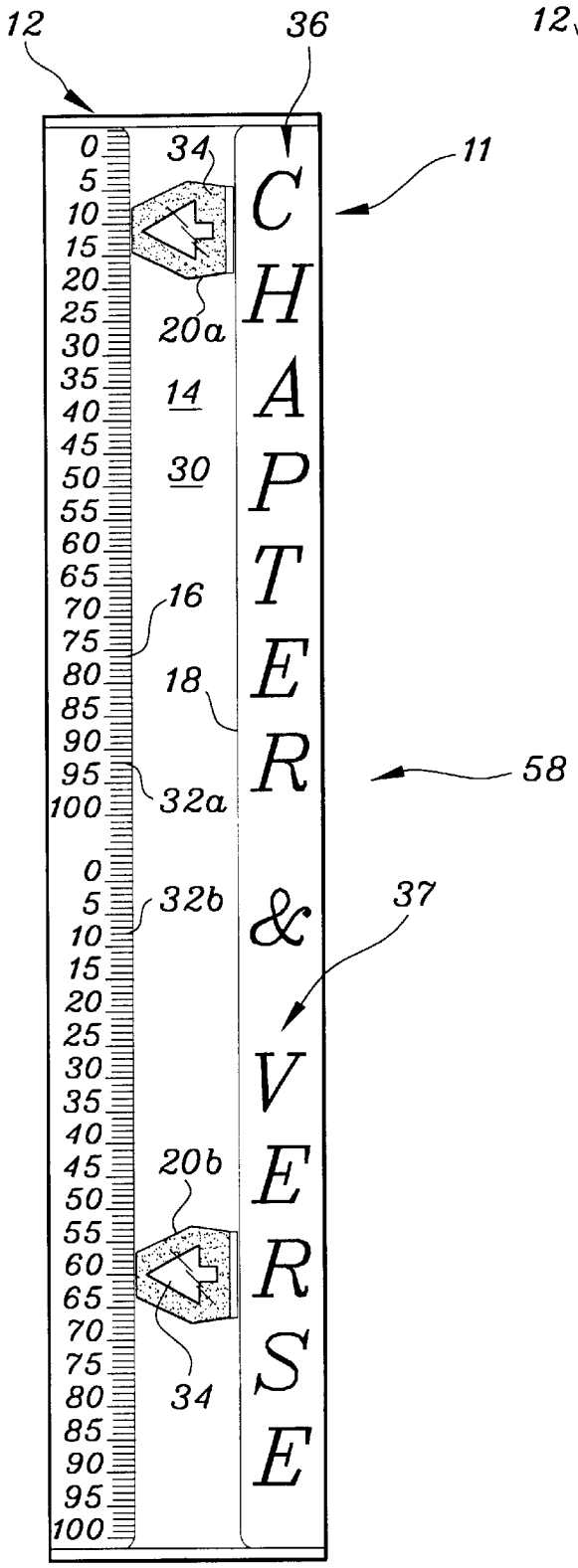
FIG. 10 is a front elevational view of a Bible bookmark and trivia game device according to the present invention, illustrating a third design.
Figure 11:
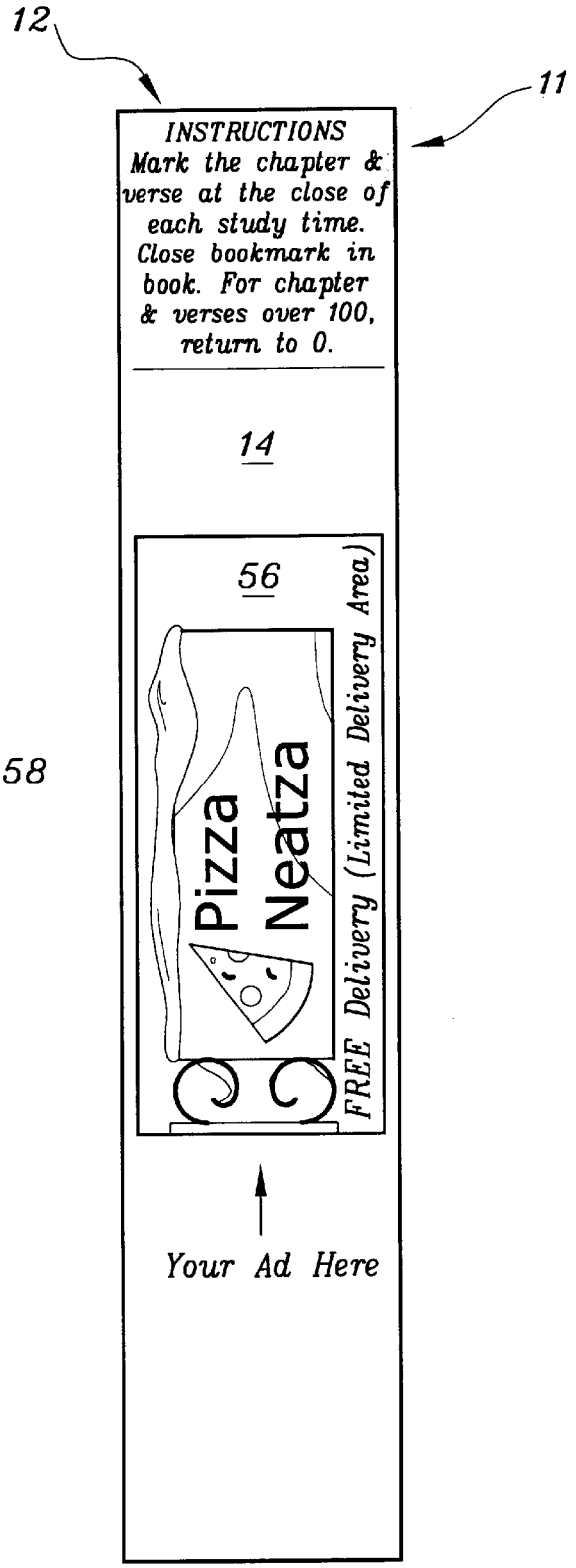
FIG. 11 is a rear elevational view of the FIG. 10 Bible bookmark and trivia game device according to the present invention, showing an advertisement.
Figure 12:
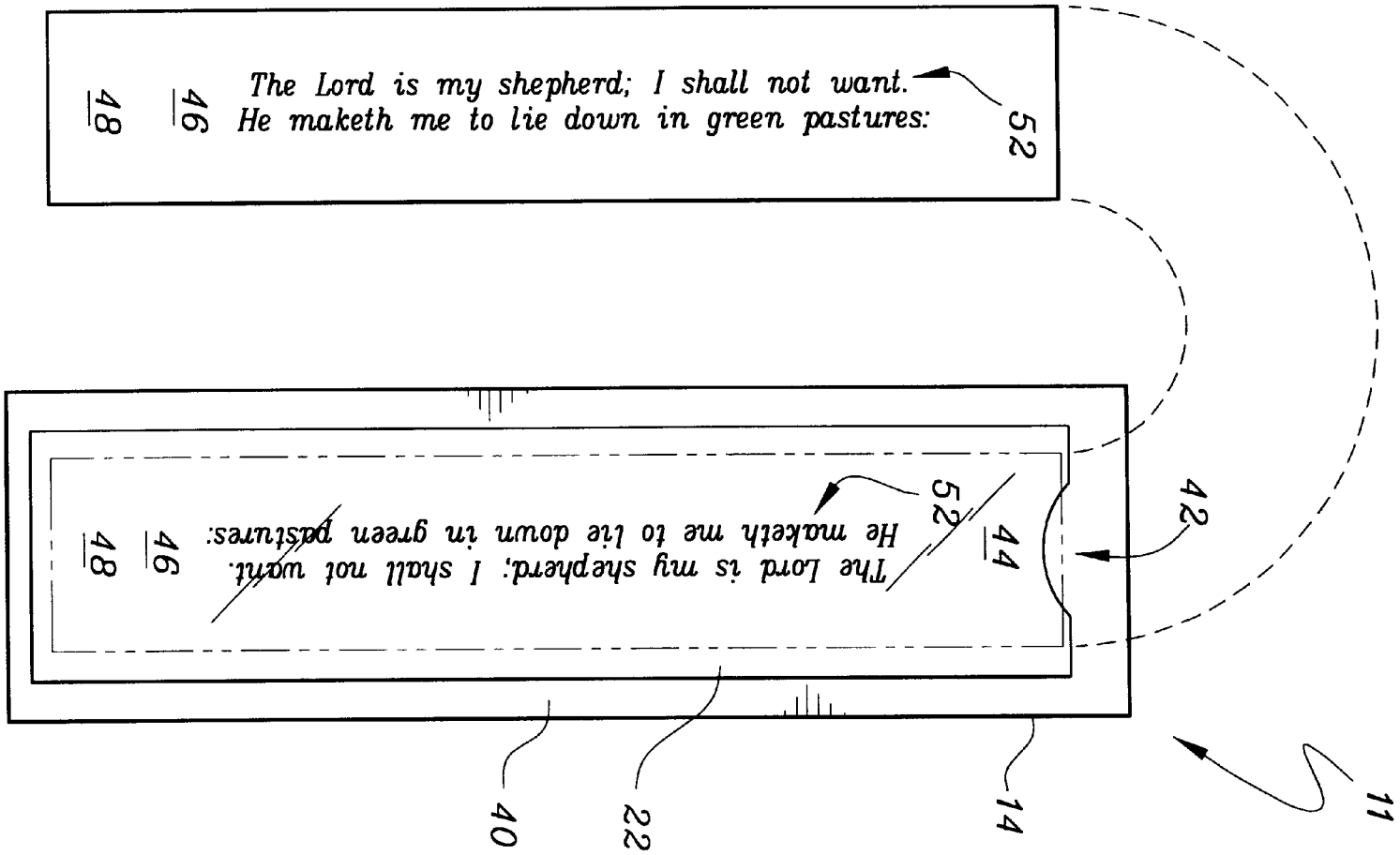
FIG. 12 is a rear elevational view of a Bible bookmark and trivia game device according to the present invention, showing a second embodiment of a transparent pocket for a trivia question card also shown outside the pocket.
Figure 13A:
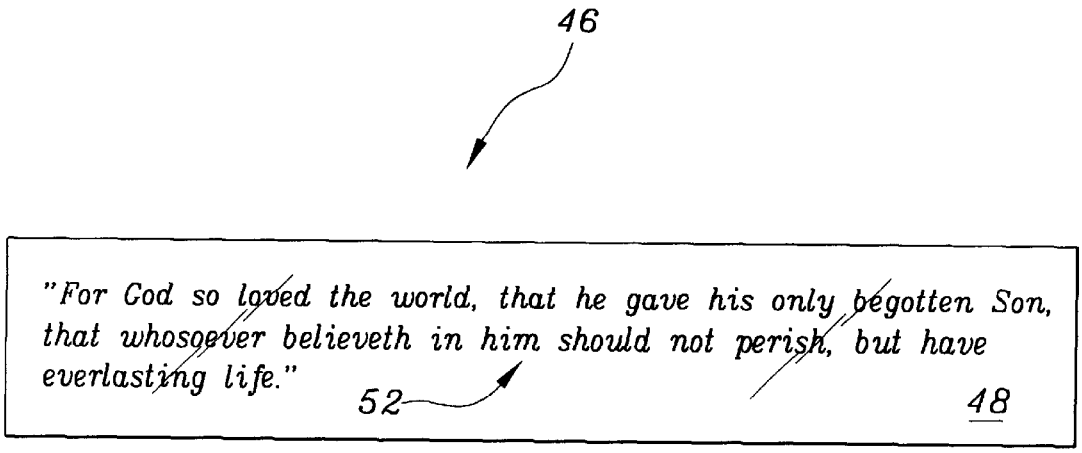
FIG. 13*a* is a front elevational view of a second embodiment of a trivia question card according to the present invention.
Figure 13B:
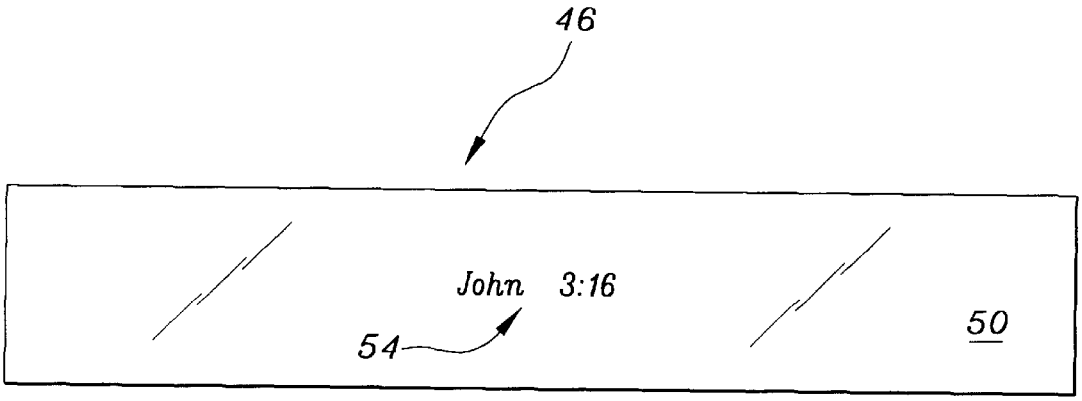
FIG. 13*b* is a rear elevational view of the trivia question card of FIG. 13*a* having the answer according to the present invention.
Figure 14:
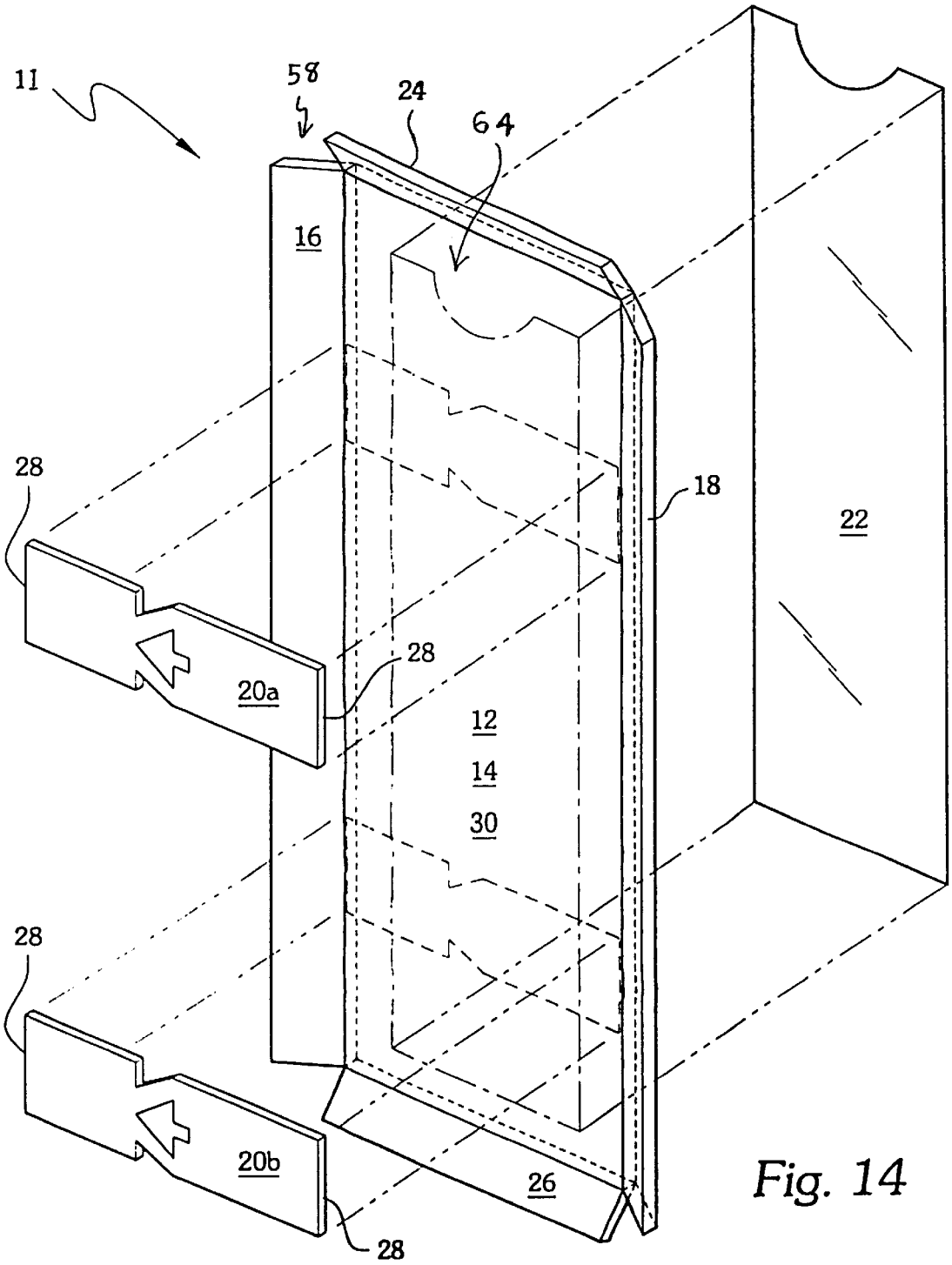
FIG. 14 is an exploded front perspective view of a second embodiment of a Bible bookmark and trivia game device according to the present invention.

A second embodiment of a bookmark 11 is illustrated in FIGS. 10–14. Referring specifically to FIGS. 10, 12 and 14, the bookmark 11 includes a planar base 12 having a rear panel 14. A front portion 58 comprises a first (left) side 16, a second (right) side 18, sliding arrow indicators 20*a*, 20*b*, and a transparent panel 22.

FIG. 14 illustrates by an exploded illustration, the second bookmark/trivia game 11. The base 12 is made from a single piece of material and comprises a left side panel 16, a right side panel 18, a top panel 24, and a bottom panel 26 which extend outwardly in an inclined direction from the rear panel 14. A pair of sliding arrow indicators 20*a*, 20B are placed on the front surface 30 of the rear panel 14, with an upper arrow indicator 20*a* adjacent to the upper portion of rear panel 14, and a lower arrow indicator 20*b* adjacent to the lower portion of rear panel 14. Panel sides 16, 18 are folded across the front of rear panel 14, covering each end 28 of arrow indicators 20*a*, 20B. The top panel 24 and the bottom panel 26 are also folded over the front surface 30 of the rear panel 14. The resulting base 12 forms a channel 64 wherein the arrows indicators 20*a*, 20*b* are securely and slidably contained. Each of the arrow indicators 20*a*, 20*b* includes means for slidably securing them within the channel 64. In this second embodiment, the length of the arrow indicators 20*a*, 20*b* is slightly less than the width of the bookmark 11, so that the ends 28 of the arrow indicators 20*a*, 20*b* are secured between the left and right panels 16, 18 and the rear panel 14, and prevented from exiting the channel by folded top panel 24 and bottom panel 26.

In FIG. 10, the front face or surface 30 of the bookmark 11 is shown. First, front or left side panel 16 includes an upper series of numerical indicia 32*a* corresponding to arrow indicator 20*a* with arrow indicia 34 and a lower series of numerical indicia series 32*b* corresponding to arrow indicator 20*b* with arrow indicia 34 on a raised surface with an indentation (hidden) on an inside edge. The second, front or left side panel 18 includes alphanumeric naming indicia 36, 37, designating the purpose of each series of each numerical indicia series 32*a*, 32*b*, respectively, on another raised surface with a similar indentation on an inside edge. The inside edges of the panels 16 and 18 serve to hold the arrow indicators 20*a* and 20*b* with hidden external lips slidably in the channel 64. In the illustrated example, the bookmark 11 is intended for use with a Bible 38. Therefore, the upper arrow indicator 20*a* and the upper numerical indicia 32*a* is designated as "Chapter" for indicating the chapter wherein reading was stopped. The lower arrow indicator 20*b* and the lower numerical indicia 32*b* is designated "Verse" for indicating the last verse read. By sliding upper arrow 20*a* to the number corresponding to the appropriate chapter, sliding lower arrow 20*b* to the number corresponding to the appropriate verse, and placing bookmark 11 between the pages of book 38 in FIG. 1, the reader can mark the exact location where reading was stopped.

With reference to the first embodiment illustrated in FIGS. 5, 6, 8, and 9, the rear surface 40 of the bookmark 10 is shown. Transparent panel 22 attaches to the rear surface 40 of the rear panel 14, forming a pocket 44 defined between transparent panel 22 and rear panel 14, having a pocket opening 42 near the top of the bookmark 10. Opaque indicia 74 conceals one small portion of the contents of pocket 44. Referring specifically to FIGS. 5, 6, 7*a*, and 7*b*, the pocket 44 may contain a combination trivia question and prayer list card 46 having a question 52 and an answer 54 on its front face 48, and a prayer list 76 on its rear face 50.

In FIGS. 13*a* and 13*b*, the list card 46 can have a question 52 on a front face 48 with the answer 54 on its rear face 50, respectively.

Figure 5:
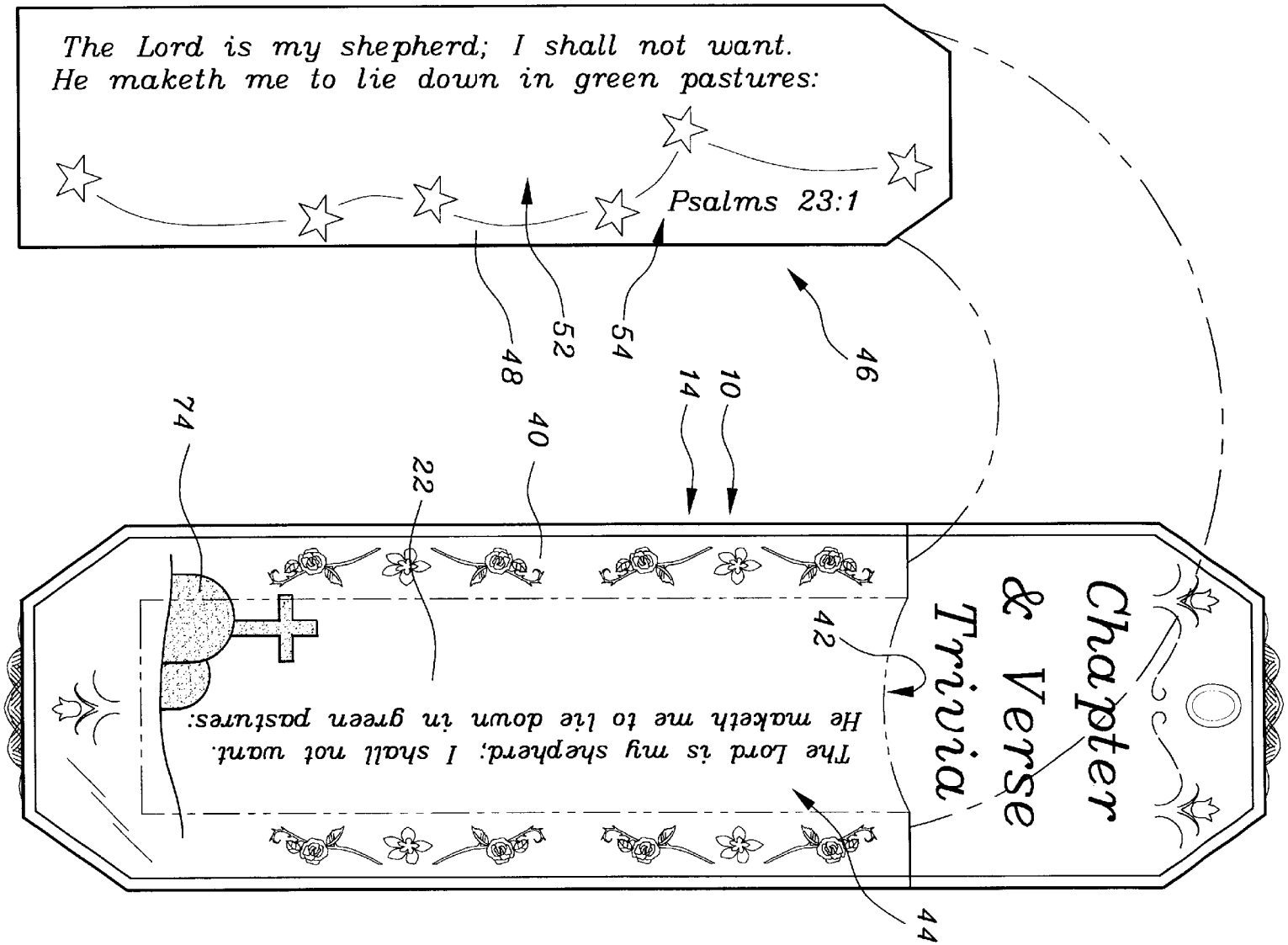
FIG. 5 is a rear elevational view of a Bible bookmark having a pocket and a front elevational view of an inverted trivia question card to fit into the pocket as a first embodiment according to the present invention.

In the illustrated examples, the question is in the form of a Bible verse and the answer is the location of that verse by book name/author, chapter number, and verse number within the Bible 38. When the trivia question card 46 is inserted into pocket 44 as illustrated in FIG. 5, the front face 48 of the card 46 with question 52 is visible through the transparent panel 22, while the opaque indicia 74 conceals answer 54. A player attempts to guess the correct location of the verse 52 by sliding the arrow 20*a* to the appropriate chapter, and then sliding the arrow 20*b* to the appropriate verse. The players take turns guessing until one guesses correctly, at which time the trivia question card 46 is removed and a new trivia question card 46 is inserted into the pocket 44.

Figure 6:
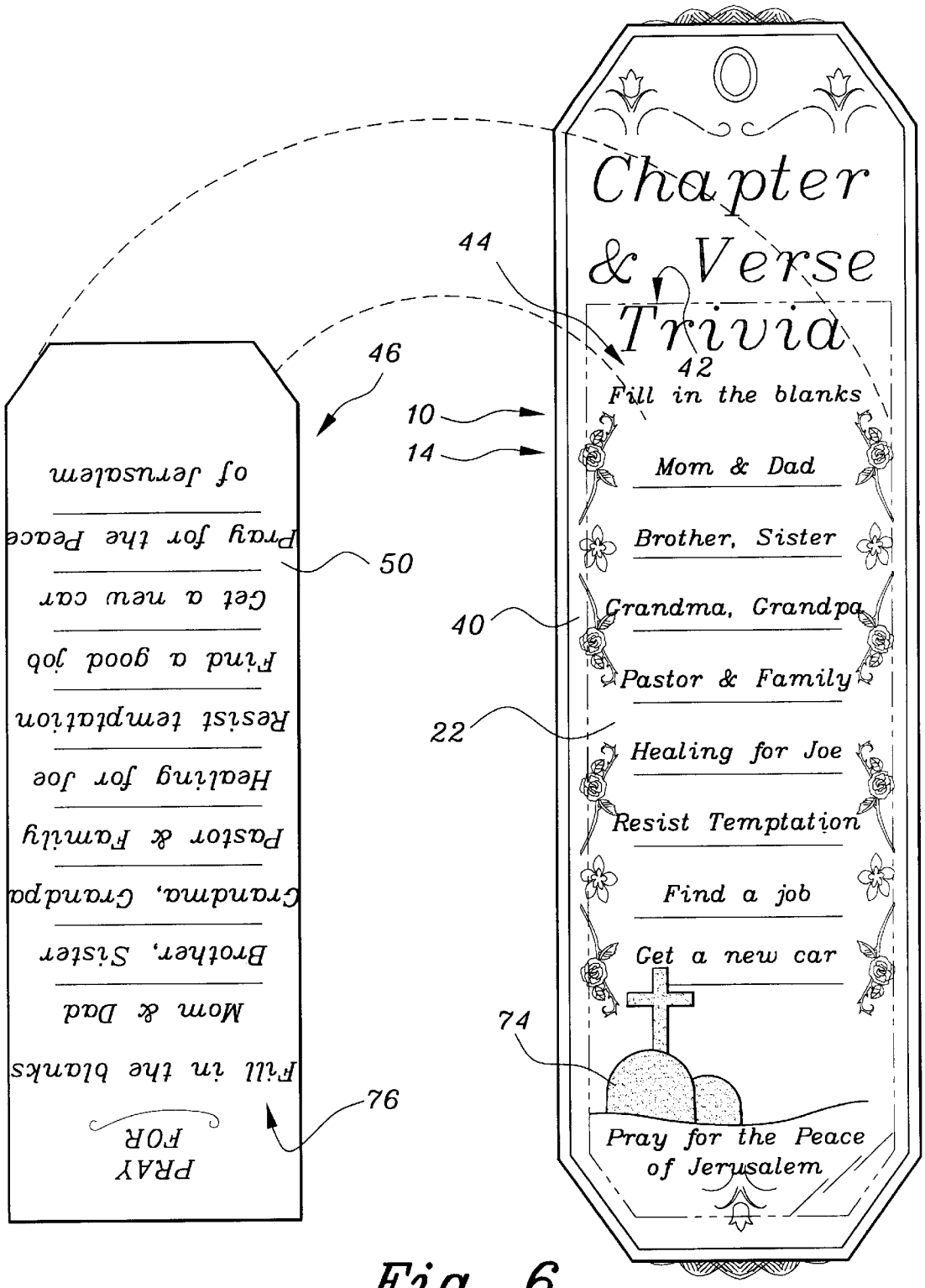
FIG. 6 is a rear elevational view of a Bible-bookmark having a pocket and a front elevational view of an inverted prayer list. card according to an alternative to the FIG. 5 invention.
Figure 7A:
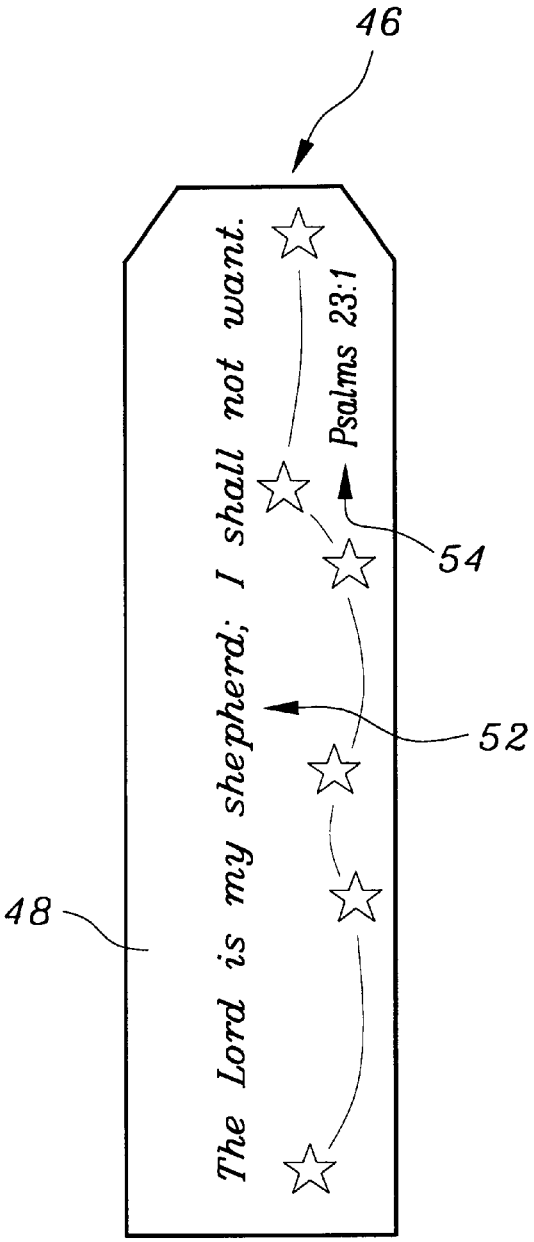
FIG. 7*a* is a front elevational view of the alternative trivia question card of FIG. 6 according to the present invention.
Figure 7B:
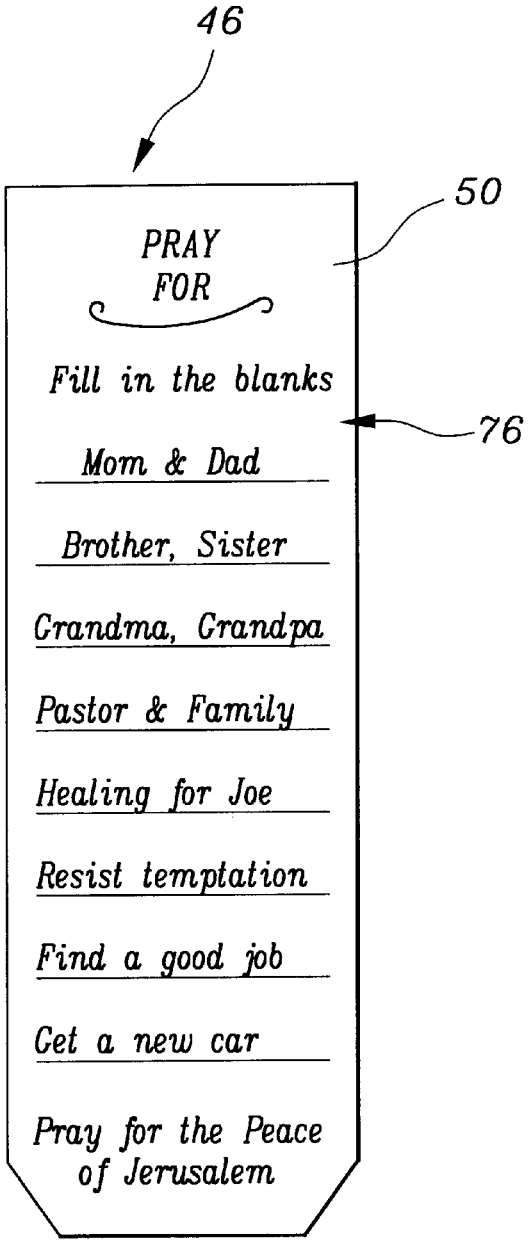
FIG. 7*b* is a rear view of the trivia question card of FIG. 7*a* according to the present invention, showing the prayer list therein.

Alternatively, the card 46 can be inserted into pocket 44 with its rear face 50 visible, as illustrated in FIGS. 6 and 7*b*. The prayer list 76 is now visible. Christians and members of some other religions will commonly pray not only for themselves, but for others, and those who take prayer seriously will frequently pray about a large number of concerns. The prayer list 76 serves as a reminder of those concerns for which prayer is currently desired, ensuring that the user does not forget any items.

Referring to FIGS. 12 and 14, a second alternative rear surface 40 of the bookmark 11 is shown. Transparent panel 22 attaches to the rear surface 40 of rear panel 14, forming a pocket 44 defined between transparent panel 22 and rear panel 14, having a pocket opening 42 near the top of the bookmark 11. Referring to FIGS. 12, 13*a*, and 13*b*, the pocket 44 contains a trivia question card 46 having a question 52 on its front face 48 and the answer 54 on its rear face 50. In the illustrated examples, the question is in the form of a Bible verse, and the answer is the location of that verse, by book name/author, chapter number, and verse number, within the Bible. When the trivia question card 46 is inserted into pocket 44, the front face 48 with question 52 is visible through transparent panel 22, while the rear face 50 and answer 54 are concealed. A player attempts to guess the correct location of the verse 52 by sliding the arrow 20*a* to the appropriate chapter, and then sliding the arrow 20*b* to the appropriate verse. The players take turns guessing until one guesses correctly, at which time the trivia question card 46 is removed and a new trivia question card 46 is inserted into the pocket 44.

Figure 8:
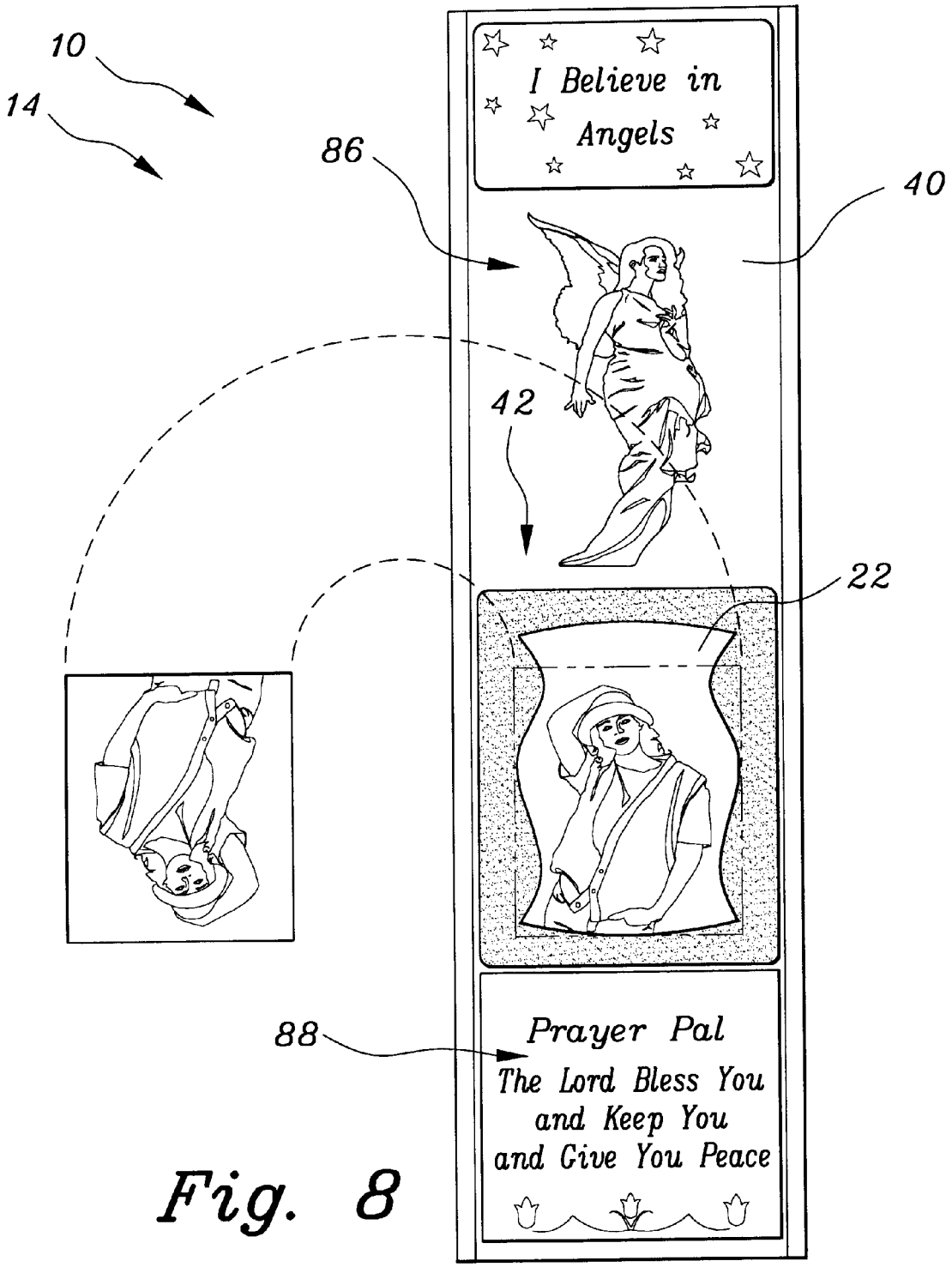
FIG. 8 is a rear elevational view of a Bible bookmark and trivia game device according to the present invention, showing a transparent pocket on the bookmark for a prayer pal photo shown also in a displaced position.

Referring to FIG. 8, a third alternative rear surface 40 is illustrated. Transparent panel 22 is now dimensioned and configured to form a pocket 44 suitable for holding a small photo 78. The photo 78 is suggested to depict a prayer partner of the user. Christians are taught to pray in groups, and to pray for individual members of the group when the group is separated. The photo 78 can serve as a reminder of someone who the user remembers in one's prayers.

Figure 9:
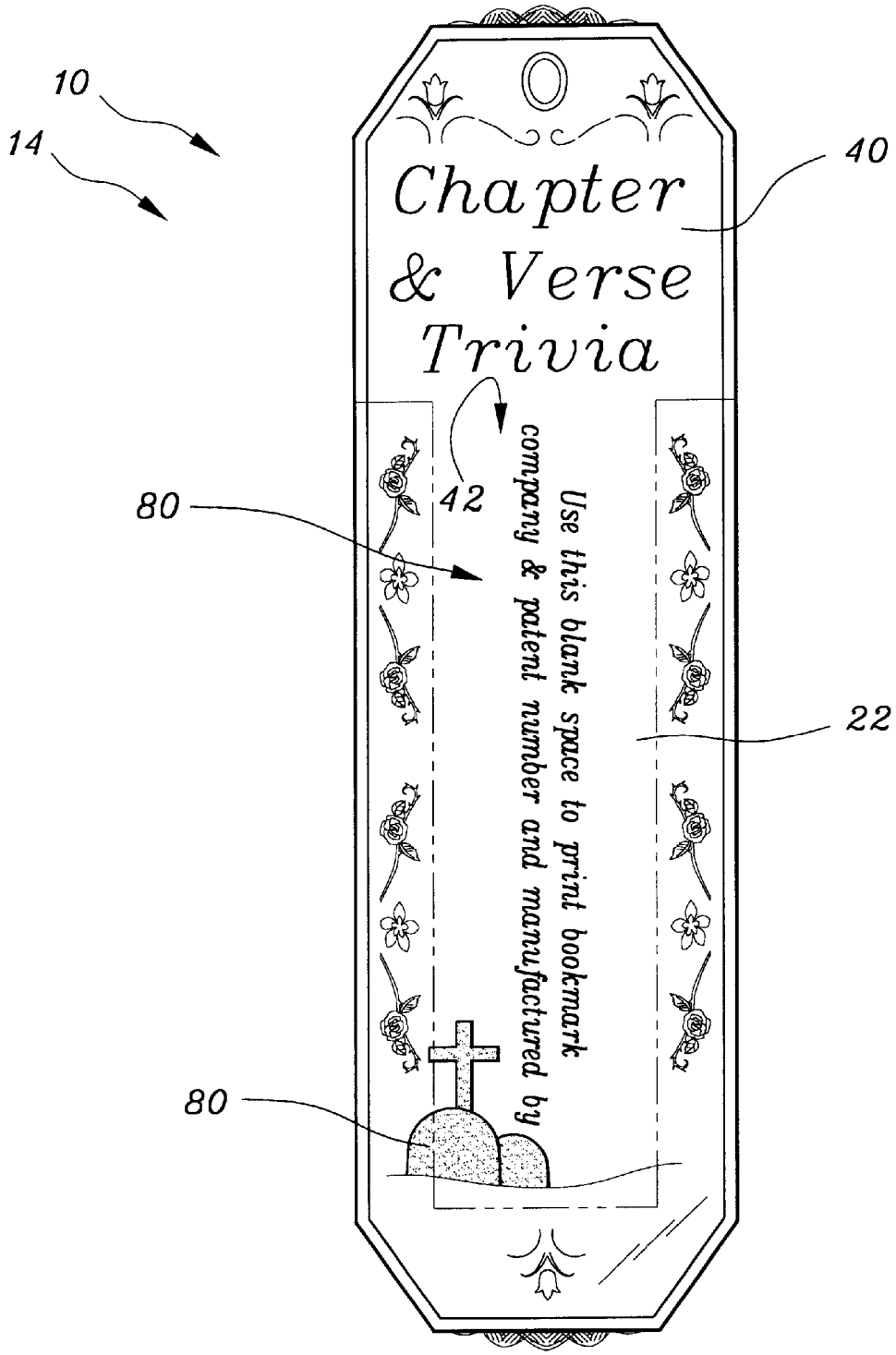
FIG. 9 is a rear elevational view of a Bible bookmark and trivia game device according to the present invention, showing a preferred location of patent status and manufacturer information.

Referring to FIG. 11, a fourth alternative rear panel 14 may include an advertisement 56, instead of transparent panel 22. The advertisement 56 and transparent panel 22 will generally not appear together on the same bookmark 11, but are not necessarily mutually exclusive. For example, FIG. 9 illustrates how patent status information and manufacturer information 80 can be placed on the rear surface 40 of bookmark 10, so that they are visible through transparent panel 22 when the pocket 44 is empty. An advertisement could be placed in the same location.

Referring back to FIGS. 2, 3, and 8, it is suggested that the bookmark 10 can contain several decorative features. For example, a braided gold chain 82 (FIG. 3) may surround the front panel 58. Gem stones 84 may be positioned on the arrow indicators 20*a*, 20*b* as depicted in FIGS. 2 and 3. Religious designs 86 and words of encouragement 88 can also be printed on the bookmark 10 as seen in FIG. 8.

It is to be understood that the present invention is not limited to the sole embodiments described above, but encompasses any and all embodiments within the scope of the following claims.

I claim:

1. A bookmark for a Bible and trivia game device, comprising:

a rectangular rear panel including a top, a bottom, a front surface and a rear surface, said rear panel having a vertically centered first channel penetrating only the front surface and extending from adjacent the top to adjacent the bottom;

a front panel commensurate in size and shape with said rear panel, said front panel having a vertically centered second channel defined therethrough, wherein the first channel of said front panel is substantially narrower than the second channel of the rear panel; an upper arrow indicator and a lower arrow indicator, each secured between the front panel and the rear panel and adapted to separately slide within the first channel and the second channel, said upper arrow indicator for identifying a chapter of the Bible and said lower arrow indicator for identifying a verse of the Bible wherein reading has stopped;

a transparent panel attached to the rear surface of said rear panel to define a pocket; and a least one trivia question card insertable in the pocket, said card relating to a Biblical topic for playing a game.

2. The device according to claim 1, wherein said at least one trivia question card includes a plurality of trivia question cards.

3. The device according to claim 1, further comprising at least one prayer request card insertable in the pocket.

4. The device according to claim 1, wherein each said upper arrow indicator and said lower arrow indicator includes a transparent tip.

5. The device according to claim 1, wherein said front panel includes a decorative border.

6. The device according to claim 1, wherein each said upper arrow indicator and said lower arrow indicator includes a gem stone.

* * * * *